United States Patent [19]

Majewicz et al.

[11] Patent Number: 4,994,112

[45] Date of Patent: Feb. 19, 1991

[54] HYDROPHOBICALLY MODIFIED CELLULOSIC THICKENERS FOR PAPER COATING

[75] Inventors: Thomas G. Majewicz, Kennett Square, Pa.; Teng-Shau Young, Wilmington, Del.

[73] Assignee: Aqualon Company, Wilmington, Del.

[21] Appl. No.: 429,195

[22] Filed: Oct. 30, 1989

[51] Int. Cl.[5] ..... C08L 1/04

[52] U.S. Cl. ..... 106/169; 106/774

[58] Field of Search ..... 106/774, 169, 193.1

[56] References Cited

U.S. PATENT DOCUMENTS

| | | | |
|---|---|---|---|
| Re. 33,008 | 8/1989 | Ruffner et al. | 526/270 |
| 4,154,899 | 5/1979 | Helm et al. | 428/537 |
| 4;228,277 | 10/1980 | Landoll | 536/90 |
| 4,243,802 | 1/1981 | Landoll | 536/91 |
| 4,248,939 | 2/1981 | Parsons | 427/411 |
| 4,840,705 | 6/1989 | Ikeda et al. | 162/175 |
| 4,845,207 | 7/1989 | t'Sas | 536/91 |

FOREIGN PATENT DOCUMENTS 307795 9/1988 Fed. Rep. of Germany .

OTHER PUBLICATIONS

"Natrosol R in Pigmented Coating for Paper and Paperboard", Hercules Pub., 456-2, Hercules Inc.

*Primary Examiner*—William R. Dixon, Jr.
*Assistant Examiner*—David M. Brunsman
*Attorney, Agent, or Firm*—James K. Luchs

[57] ABSTRACT

Hydroxyalkylcellulose hydrophobically modified with a C12 to C16 alkyl or aralkyl group represents a preferred thickener for a paper coating composition to obtain uniform coating at high speed. The process for manufacture involves: preparing an aqueous coating composition of hydrophobically modified hydroxyethylcellulose, pigment binder and other additives; applying the composition to a paper surface; removing excess composition to produce a uniform coating; and drying to produce a paper product.

11 Claims, 1 Drawing Sheet

HYDROPHOBICALLY MODIFIED CELLULOSIC THICKENERS FOR PAPER COATING

FIELD OF THE INVENTION

The invention relates to the use of cellulosic thickeners in coatings which are applied to paper products. In particular the invention relates to improved coating efficiency when a hydrophobically modified cellulosic thickener is used.

BACKGROUND OF THE INVENTION

U.S. Pat. No. 4,154,899 describes the use of pigment, clay and modified starch ether for coating compositions which are applied to paper during manufacture European Patent Application EP 307-795 describes a pigment dispersion used for paper coating which can contain modified starch, galactomannan, MC (methylcellulose) or CMC (carboxymethylcellulose). A quaternary starch ether is employed in the papermaking method of U.S. Pat. No. 4,840,705.

It is further known from Aqualon ® publication 250-11C, Natrosol ®—Hydroxyethylcellulose—A Nonionic Water Soluble Polymer—Physical and Chemical Properties, that this cellulosic can be used in coating colors and size press solutions to control water binding, solids holdout and rheology. Hercules Incorporated product data publication 456-2, Natrosol ® R in Pigmented Coatings for Paper and Paperboard, contains viscosity data useful for selection of a grade of product for a papermaking application.

U.S. Pat. Nos. 4,834,207, 4,228,277 and 4,243,802 describe hydrophobically modified hydroxyethylcellulose (HMHEC) for use in latex paints and shampoos. Chain lengths from C10 to C24 provide the hydrophobic modification.

Still it remained for the present invention to teach a new and useful coating composition and process of use applicable to paper manufacture.

SUMMARY OF THE INVENTION

It is an object of the invention to provide an aqueous paper coating composition comprising a polysaccharide thickener, characterized in that the thickener is a water soluble hydrophobically modified alkylcellulose and/or hydroxyalkylcellulose. It is preferred that a C12 to C16 alkyl or arylalkyl group modifies a hydroxyethylcellulose as an effective associative thickener.

An improved process for paper manufacture involves the steps:

(1) preparing an aqueous coating composition with hydrophobically modified alkylcellulose and/or hydroxyethylcellulose, pigment and binder, (2) applying the composition to a semiabsorbent surface;

(3) removing excess composition to provide a uniform coating; and (4) drying to produce a paper product.

The hydrophobically modified hydroxyalkylcellulose can be added as the sole thickening agent or in combination with other thickening agents. Dry powders or fluid suspensions containing combinations of materials may be used.

DETAILED DESCRIPTION OF THE INVENTION

Figure 1:
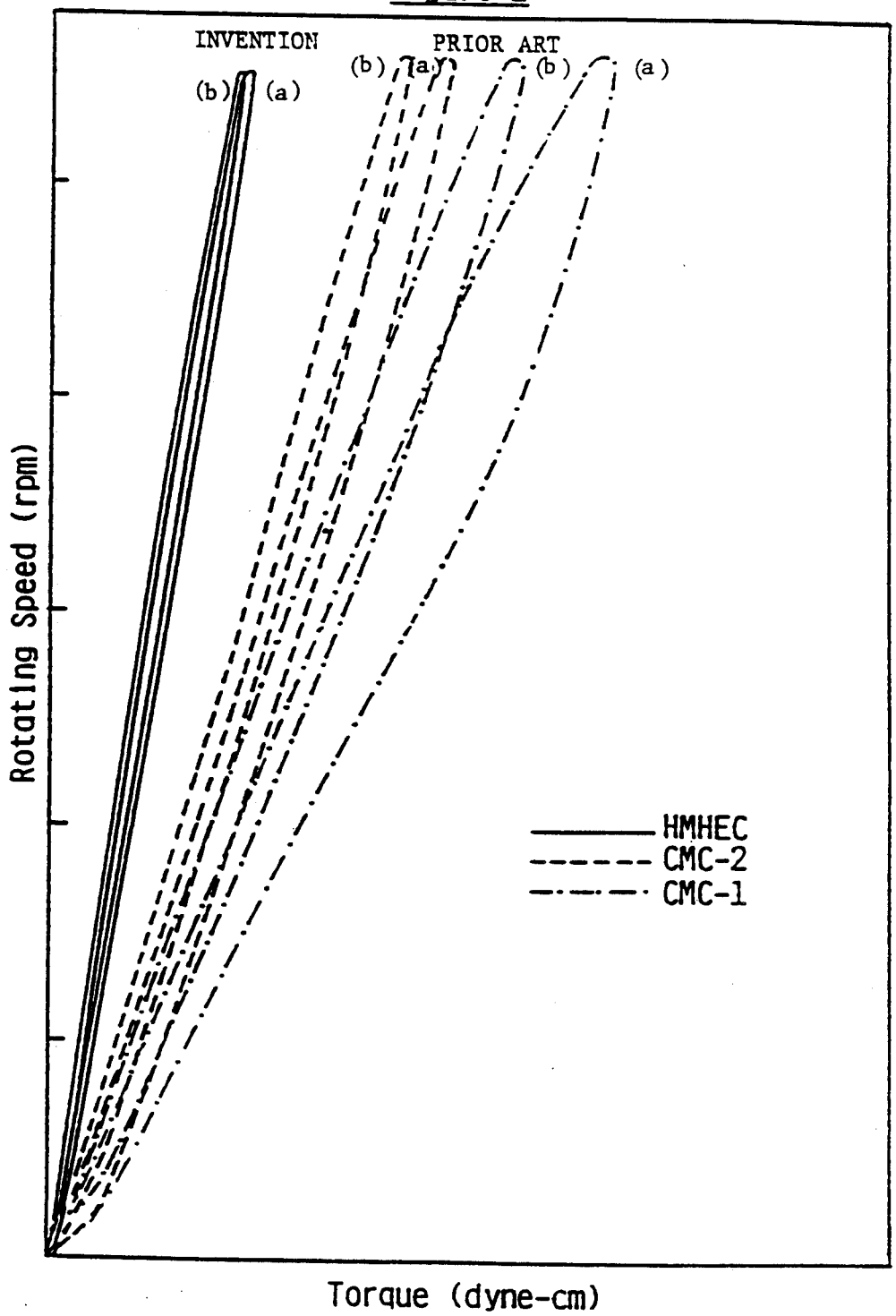
FIG. 1. High shear viscosities of the invention are illustrated in comparison with two controls.

In common with other industries the paper and paperboard manufacturers seek to improve productivity and lower mill cost. One of the problems limiting their ability to coat at higher speeds has been nonuniformity and quality defects using existing coating compositions and techniques.

Associative thickeners which associate with themselves are useful in the practice of the present invention providing improved rheology in paper coating compositions applied with a metering blade, rod or air knife. They provide high thickening efficiency with high pseudoplasticity in high solids content coating compositions. During blade coating a hydrophobically modified cellulosic allows lower blade pressures to be used with a resulting improvement in coating quality at high speeds. Lower blade pressure resulting from the use of associative thickeners can reduce water loss to the paper stock, web breaking and streaking, particularly at high coating speed.

In view of the considerable prior effort made to overcome these problems, it was a surprising result to find how efficient the composition and process of the invention were in meeting the aims of the paper industry. By reducing blade pressure, coating speeds can be increased by 10 to 25%. Uniform paper surfaces can be produced using lower amounts of thickeners. Higher productivity can be achieved without sacrifice of quality or significantly increasing costs.

Cellulosic thickening agents having suitable hydrophobic modification are available from the Aqualon Company. A preferred modified cellulosic is Natrosol ® Plus. An Aqualon publication, Natrosol ® Plus 250-18A, describes how this material functions as an associative thickener in paint, but gives no suggestion of the present invention. Another suitable associative thickener is ethylhydroxyethylcellulose, Bermocoll ® EHM 100 from Berol Nobel.

Depending upon the needs of the paper manufacturer it may be desirable to use one or more hydrophobically modified cellulosics in combination with one or more conventional thickeners such as CMC (carboxymethylcellulose) or HEC (hydroxyethylcellulose) Thus by partially replacing CMC or HEC in an existing coating composition with hydrophobically modified hydroxyethylcellulose (HMHEC), it would be possible to lower the high shear viscosity by increments.

Typical ingredients for paper coating compositions in addition to thickeners include: pigments (e.g., kaolin clay, calcium carbonate, gypsum, titanium dioxide, etc.), polymeric binder (e.g., styrene-butadiene latex, protein, starch, etc.), lubricants such as glycols and fatty acids, insolubilizers and defoamers. Once prepared as a coating composition it is usual practice in the industry to measure viscosity and rheology properties of the composition prior to an actual test of the composition. In this way a body of knowledge was built up by comparison of such results with the actual quality and reproduceability provided by any of the compositions tested. For instance, desirable Brookfield viscosities measured at 100 rpm are in the 500 to 3000 mPa.s range, while high shear viscosity is best between 20 and 100 mPa.s.

Kaltec Scientific, Inc., 22425 Heslip Drive, Novi, Mich. 48050 supplies parts and rheogram paper for use with the Model ET24-6 Hercules ® Hi-Shear Viscometer which is in common use by the paper industry for evaluation of coating compositions.

DETAILED DESCRIPTION OF THE DRAWING

FIG. 1 illustrates sample rheograms of the invention versus sample rheograms of the prior art. Where slope is high, the high shear viscosity is low, represented by the invention, then the thickener is expected to be less resistant to flow under high shear conditions. The graph plots revolutions per minute (RPM) versus TORQUE (dyne cm). In each Hercules high shear test, the coating sample was subjected to two consecutive shear cycles. The first cycle is represented by (a) and the second cycle by (b); both cycles were conducted from static to 4000 rpm in 20 seconds. Reported values are taken from the (b) cycle since the (a) cycle only serves to break down the excessive structure developed during storage.

The (a) and (b) cycles of HMHEC according to the invention in comparison to the (a) and (b) cycles of two prior art CMC controls clearly show the advantage in terms of relatively low resistance to flow at high shear.

| Formulation Ingredients | Paper Coating Compositions A | B | C | D |
|---|---|---|---|---|
| | Amounts in Grams (Dry or 100% Active Basis) | | | |
| Hydrafine ® | 100 | 100 | 50 | — |
| Hydrasperse ® | — | — | — | 50 |
| Hydraprint ® | — | — | — | 50 |
| Hydracarb ® 65 | — | — | 50 | — |
| Dispex ® N40 | — | 0.1 | 0.1 | 0.25 |
| Dow ® 620 | 13 | 16 | 13 | 14 |
| Penford Gum ® 290 | — | — | — | 4 |
| Sunrez ® 700M | — | — | — | 0.12 |
| Flowco ® 501 | 0.5 | 1 | 0.5 | 1 |
| Hercules ® 831 | 0.2 | — | — | 0.25 |
| Thickener | varied | varied | varied | varied |
| Target Viscosity | 2300 | 2300 | 2000 | 1800 |
| Hydrafine ® | pigment, No. 1 kaolin clay, J. M. Huber Corp. | | | |
| Hydrasperse ® | pigment, No. 2 kaolin clay, J. M. Huber Corp. | | | |
| Hydraprint ® | pigment, delaminated clay, J. M. Huber Corp. | | | |
| Hydracarb ® 65 | pigment, ground $CaCO_3$ suspension. Omya Inc. | | | |
| Dispex ® N40 | clay dispersant, Allied Colloids Inc. | | | |
| Dow 620 | binder, styrene-butadiene latex, Dow Chemical Co. | | | |
| Penford Gum 290 | binder, hydroxyethylated starch, Penick & Ford, Ltd. | | | |
| Sunrez ® 700M | insolubilizer for starch, Sun Chemical | | | |
| Flowco ® 501 | lubricant, calcium stearate dispersion, Mallinckroft | | | |
| Hercules ® 831 | defoamer, Hercules Incorporated | | | |

PREPARATION

The paper coating compositions which were used in the following examples were prepared by mixing together the indicated amounts of ingredients. The total solids in weight percent, varied from 58 to 64% for controls and experimental compositions. The coating compositions were all adjusted to pH 8. The usage level of thickener was varied to obtained the target viscosity as measured with a Brookfield Viscosity at 100 rpm.

The following examples illustrate the practice of the invention which has industrial application in paper coating.

EXAMPLE 1

The following example illustrates the effects of the hydrophobically modified (HM) cellulosic ethers on the properties of kaolin clay-based coating colors. Coating colors containing 60% solids (by weight) were prepared based on Formulation A. This formulation comprises of a fine kaolin clay and a styrene butadiene latex as the primary pigment and binder. A variety of hydrophobically modified cellulosic ethers were used to thicken the coating colors to a Brookfield viscosity of 2300 mPa.s at 100 rpm. For comparison purpose, two control coating colors were also prepared using CMC as the thickener. The amount of thickener used and the rheological properties of the colors are summarized in Table 1.

Table 1 contains comparative data for 60% solids coating compositions. The Hercules ® high shear viscosities were measured at 22,500 and 45,000 $s^{-1}$ respectively.

TABLE 1

| Thickener | Concentration Parts | Brookfield Viscosity mPa.s @ 100 rpm | Hercules Viscosity 22500/ 45000 reciprical seconds |
|---|---|---|---|
| CMC (control) | 2.60 | 2200 | 72.2/61.1 |
| CMC (control) | 1.10 | 2200 | 56.2/47.2 |
| CMC (control) | 0.72 | 2250 | 45.5/38.2 |
| Natrosol ® Plus 330 | 0.51 | 2400 | 31.9/29.8 |
| EHM 100 | 0.58 | 2240 | 38.9/36.8 |
| NP-HMHEC | 0.57 | 2400 | 41.0/35.7 |

As shown in Table 1 all three hydrophobically modified associative thickeners gave improved high shear performance over the three controls.

In Table 1 the control CMCs are of Grade 7 available from the Aqualon Company. Natrosol ® Plus Grade 330 and NP-HMHEC (nonylplenyl hydrophobically modified hydroxyethyl cellulose) are available from the Aqualon Company. EHM 100 is a hydrophobically modified ethylhydroxyethylcellulose available from Berol Nobel.

The coating colors were applied onto a light weight paper using a cylindrical laboratory coater (CLC). Acceptable blade coating runnability was observed from the HMHEC thickened colors at web speeds up to 4000 feet per minute. The HMHEC coating color gave lower coat weight (CW) than the CMC controls at the same blade/web gap setting or blade pressure. Table 2 contains comparative results with coating speed in m/min, blade setting gap for the blade for coating in mm, and coating weight in $g/m^2$.

TABLE 2

| Thickener | Solids | Speed | Gap | CW |
|---|---|---|---|---|
| CMC (Control 1) | 60.0 | 1225 | 4.191 | 13.3 |
| CMC (Control 2) | 60.0 | 1225 | 4.293 | 10.6 |
| Natrosol ® Plus 330 | 60.0 | 1225 | 4.191 | 7.8 |
| Natrosol ® Plus 330 | 60.0 | 1225 | 4.267 | 9.3 |
| NP-HMHEC | 60.0 | 1225 | 4.191 | 8.3 |

EXAMPLE 2

Coating compositions were prepared and tested as in Example 1 except that formulations B, C, and D were used in place of formulation A. Table 3 gives comparative results. The concentration of thickener in each coating was based on 100 parts of pigments(s); Hercules ® high shear viscosities were measured at 22500 and 45000 $s^{-1}$. AQU-D3082 is a developmental hydrophobically modified hydroxyethylcellulose from Aqualon.

TABLE 3

| Thickener | Formula | Concentration (parts) | Solids (%) | Hercules Viscosity 22500/45000 | |
|---|---|---|---|---|---|
| CMC (control) | B | 0.80 | 64 | 97.2 | 78.4 |
| Natrosol ® Plus 330 | B | 0.40 | 64 | 77.8 | 68.0 |
| AQU-D3082 | B | 0.55 | 64 | 79.1 | 70.1 |
| NP-HMHEC | B | 0.40 | 64 | 70.8 | 61.7 |
| CMC (control) | C | 1.40 | 60 | 52.8 | 42.3 |
| Natrosol ® Plus 330 | C | 0.60 | 60 | 33.3 | 27.0 |
| CMC (control) | D | 0.50 | 62 | 113.9 | 75.6 |
| CMC (control) | D | 0.77 | 60 | 90.3 | 65.2 |
| Natrosol ® Plus 330 | D | 0.22 | 62 | 112.5 | 69.4 |
| Natrosol ® Plus 330 | D | 0.31 | 60 | 75.0 | 54.8 |

EXAMPLE 3

Coating compositions were prepared using Formulation D where a starch, i.e. Penford Gum 290, was added as co-binder. Table 4 contains results.

TABLE 4

| Thickener | % Add | % Solids | Hercules Viscosity 22500/45000 $S^{-1}$ | |
|---|---|---|---|---|
| CMC | 0.30 | 64 | 166.7 | 95.0 |
| Natrosol ® Plus 330 | 0.05 | 64 | 143.0 | 88.8 |
| CMC | 0.50 | 62 | 113.9 | 75.6 |
| Natrosol ® Plus 330 | 0.16 | 62 | 108.3 | 70.0 |

EXAMPLE 4

A control and experimental sample were further tested for opacity (TAPPI test 7-425), brightness (TAPPI test T-425) and IGT pick test where the velocity-viscosity product at the point of pickoff of the paper by a 31 Pa.s viscosity polyisobitene oil was measured. Table 5 gives comparative results.

TABLE 5

| Thickener | CW | Opacity | Brightness | IGT Pick |
|---|---|---|---|---|
| CMC | 7.2 | 85.0 | 77.7 | 77.5 |
| Natrosol ® Plus 330 | 5.3 | 85.3 | 78.5 | 84.0 |

As shown in the table, the lower coating weight sample of the invention has equivalent opacity and brightness along with a somewhat better resistance to ink pickoff. Equivalent coating quality was obtained for both samples. This illustrates that the low coating weight advantage produced by the invention can be obtained without sacrifice of quality or physical properties.

What is claimed is:

1. An aqueous paper coating composition containing a polysaccharide thickener, characterized in that the thickener is a water soluble hydrophobically modified alkylcellulose, alkylhydroxyalkylcellulose or hydroxyalkylcellulose.

2. The composition of claim 1 where the thickener is hydrophobically modified hydroxyethylcellulose.

3. The hydroxyethylcellulose of claim 2 hydrophobically modified with a C4 to C24 alkyl or arylalkyl group

4. The hydroxyethylcellulose of claim 2 hydrophobically modified with a C12, C14 or C16 alkyl group.

5. The composition of claim 2 where the thickener is nonylphenylhydroxyethylcellulose.

6. The composition of claim 1 where the thickener is hydrophobically modified ethylhydroxyethylcellulose.

7. An aqueous paper coating composition of clay pigment, binder and thickener, characterized in that the thickener is a hydrophobically modified hydroxyalkylcellulose and/or alkylhydroxyalkylcellulose.

8. The composition of claim 7 where the pigment is calcium carbonate.

9. The composition of claim 7 where the pigment is gypsum.

10. The composition of claim 7 where the binder is a styrene-butadiene latex.

11. The composition of claim 7 where the binder is a starch.

* * * * *